US011585541B2

(12) United States Patent
Nakashima et al.

(10) Patent No.: US 11,585,541 B2
(45) Date of Patent: Feb. 21, 2023

(54) HEATING COOKING DEVICE

(71) Applicant: Panasonic Intellectual Property Management Co., Ltd., Osaka (JP)

(72) Inventors: Takeshi Nakashima, Shiga (JP); Hiroki Hayashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/044,825

(22) PCT Filed: Apr. 23, 2019

(86) PCT No.: PCT/JP2019/017108
§ 371 (c)(1),
(2) Date: Oct. 1, 2020

(87) PCT Pub. No.: WO2019/208528
PCT Pub. Date: Jan. 31, 2019

(65) Prior Publication Data

US 2021/0095864 A1 Apr. 1, 2021

(30) Foreign Application Priority Data

Apr. 27, 2018 (JP) ..... JP2018-085912

(51) Int. Cl.
*F24C 15/32* (2006.01)
*F27D 21/02* (2006.01)
(Continued)

(52) U.S. Cl.
CPC ..... *F24C 15/322* (2013.01); *F24C 15/006* (2013.01); *F27D 21/02* (2013.01);
(Continued)

(58) Field of Classification Search
CPC ..... F24C 7/085; F24C 15/006; F24C 15/322; F27D 21/02; F27D 2021/026; H05B 6/6444; H05B 6/6447
(Continued)

(56) References Cited

U.S. PATENT DOCUMENTS

2016/0178216 A1* 6/2016 Lee ..... F24C 15/006 126/21 A
2017/0188416 A1 6/2017 Beifuss et al.
(Continued)

FOREIGN PATENT DOCUMENTS

CN 101398197 A 4/2009
CN 102141260 A 8/2011
(Continued)

OTHER PUBLICATIONS

The Extended European Search Report dated May 25, 2021 for the related European Patent Application No. 19791759.4.
International Search Report of PCT application No. PCT/JP2019/017108 dated Jul. 23, 2019.
Taiwan Search Report of Corresponding Taiwan application No. 108113414 dated Aug. 16, 2020.
(Continued)

*Primary Examiner* — Steven B McAllister
*Assistant Examiner* — Benjamin W Johnson
(74) *Attorney, Agent, or Firm* — McDermott Will & Emery LLP

(57) ABSTRACT

A heating cooking device includes: a heating chamber having a front face opening; and a heater that is provided on an upper wall of the heating chamber to heat an object to be heated stored in the heating chamber, at least part of the heater being disposed at a center of the heating chamber seen from above. The heating cooking device further includes camera that is provided on the upper wall of the heating chamber and is disposed closer to a front of the heating
(Continued)

chamber than the center of the heating chamber is when seen from above, with camera having an imaging direction inclined toward a rear side of the heating chamber with respect to a vertical direction. The heating cooking device further includes blower fan that is provided on the upper wall of the heating chamber, closer to a front of the heating chamber than the center of the heating chamber is when seen from above and is disposed at a position on one of a right side and a left side with respect to camera as seen from above, and that blows air toward camera from the one of the right side and the left side.

13 Claims, 11 Drawing Sheets

(51) Int. Cl.
*F24C 15/00* (2006.01)
*F24C 7/08* (2006.01)
*H05B 6/64* (2006.01)

(52) U.S. Cl.
CPC ..... *F24C 7/085* (2013.01); *F27D 2021/026* (2013.01); *H05B 6/6444* (2013.01); *H05B 6/6447* (2013.01)

(58) Field of Classification Search
USPC ..... 126/273 R
See application file for complete search history.

(56) References Cited

U.S. PATENT DOCUMENTS

| | | | | |
|---|---|---|---|---|
| 2017/0208652 | A1 | 7/2017 | Luckhardt et al. | |
| 2017/0223774 | A1* | 8/2017 | Cheng | F24C 7/085 |
| 2018/0058702 | A1* | 3/2018 | Jang | F24C 15/322 |
| 2018/0202665 | A1* | 7/2018 | Park | F24C 15/045 |
| 2019/0128611 | A1* | 5/2019 | Abdoo | F27D 21/02 |

FOREIGN PATENT DOCUMENTS

| | | | |
|---|---|---|---|
| CN | 106465489 | A | 2/2017 |
| EP | 3205941 | A1 | 8/2017 |
| EP | 3290808 | A1 | 3/2018 |
| JP | 48-040496 | B | 11/1973 |
| JP | 9-180876 | | 7/1997 |
| JP | 2003-056852 | A | 2/2003 |
| JP | 2008-286466 | | 11/2008 |
| JP | 2008-298299 | | 12/2008 |
| JP | 2017-527763 | | 9/2017 |
| WO | 2016/034295 | | 3/2016 |

OTHER PUBLICATIONS

English Translation of Chinese Search Report dated Jun. 23, 2022 for the related Chinese Patent Application No. 201980027608.4.

* cited by examiner

HEATING COOKING DEVICE

CROSS-REFERENCE TO RELATED APPLICATIONS

This application is a U.S. national stage application of the PCT International Application No. PCT/JP2019/017108 filed on Apr. 23, 2019, which claims the benefit of foreign priority of Japanese patent application No. 2018-085912 filed on Apr. 27, 2018, the contents all of which are incorporated herein by reference.

TECHNICAL FIELD

The present invention relates to a heating cooking device for heating food.

BACKGROUND ART

Conventionally, there is a heating cooking device including an imaging unit to image inside of the chamber (for example, see PTL 1). The heating cooking device has an imaging unit attached at the center of a ceiling of a heating chamber.

CITATION LIST

Patent Literature

PTL 1: Unexamined Japanese Patent Publication No. H9-180876

SUMMARY OF THE INVENTION

However, in the configuration where an imaging unit is attached at the center of a ceiling of a heating cooking device, a heater needs to be disposed at a position other than the center of the ceiling. In such a configuration, it is sometimes difficult to uniformly heat an object to be heated.

In addition, in a case where air is blown to the camera provided on the ceiling, an airflow path needs to be further provided on the ceiling, which has a small area and on which a plurality of members are disposed. In such a configuration, it is difficult to strongly blow air due to layout-related issues.

A heating cooking device in the present disclosure includes: a heating chamber having a front face opening; and a heater that is provided on an upper wall of the heating chamber to heat an object to be heated stored in the heating chamber, at least part of the heater being disposed at a center of the heating chamber seen from above. The heating cooking device further includes a camera that is provided on the upper wall of the heating chamber and is disposed closer to a front of the heating chamber than the center of the heating chamber is when seen from above, with the camera having an imaging direction inclined toward a rear side of the heating chamber with respect to a vertical direction. The heating cooking device further includes a blower fan that is provided on the upper wall of the heating chamber, closer to a front of the heating chamber than the center of the heating chamber is when seen from above and is disposed at a position on one of a right side and a left side with respect to the camera as seen from above, and that blows air toward the camera from the one of the right side and the left side.

With the present disclosure, at least a part of the heater is disposed at the center of the upper wall of the heating chamber, the camera is provided at a front part of the upper wall of the heating chamber while being inclined forward, and the air blower is disposed at a front part of the upper wall of the heating chamber and at a position on the right or left of the camera. As a result, the camera can be disposed on the upper part in the small heating chamber, and, at the same time, it is possible to strongly blow air against the camera.

DESCRIPTION OF EMBODIMENTS

First Exemplary Embodiment

In the following, a heating cooking device according to one aspect of the present disclosure will be described with reference to the drawings.

Overall Configuration

FIGS. 1 to 19 show the heating cooking device according to the one aspect of the present disclosure.

Figure 1:
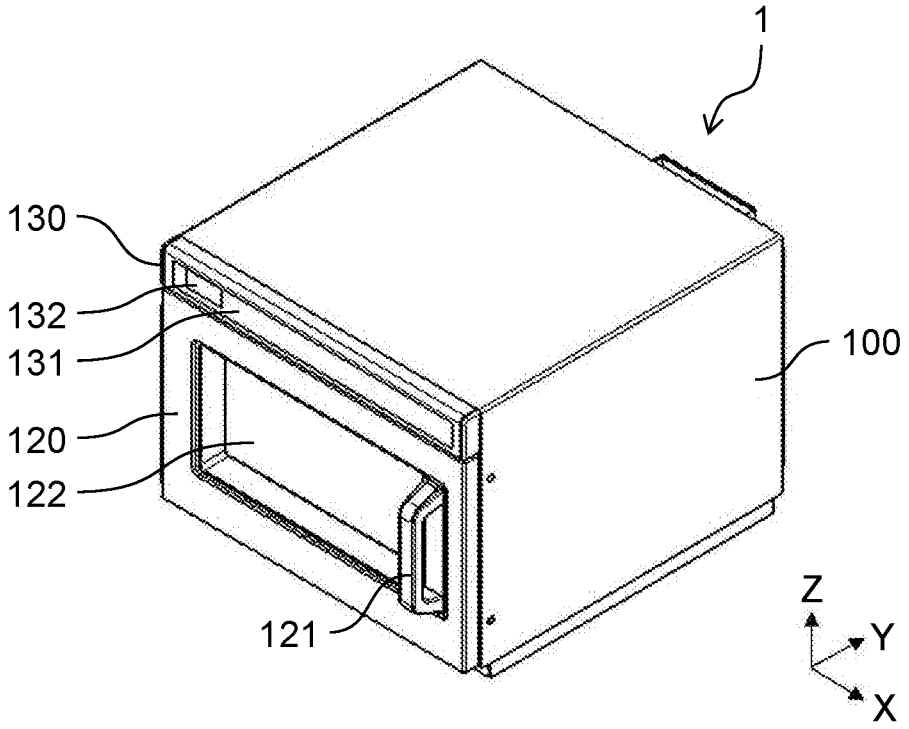
FIG. 1 is a perspective view of a heating cooking device according to one aspect of the present disclosure.
Figure 2:
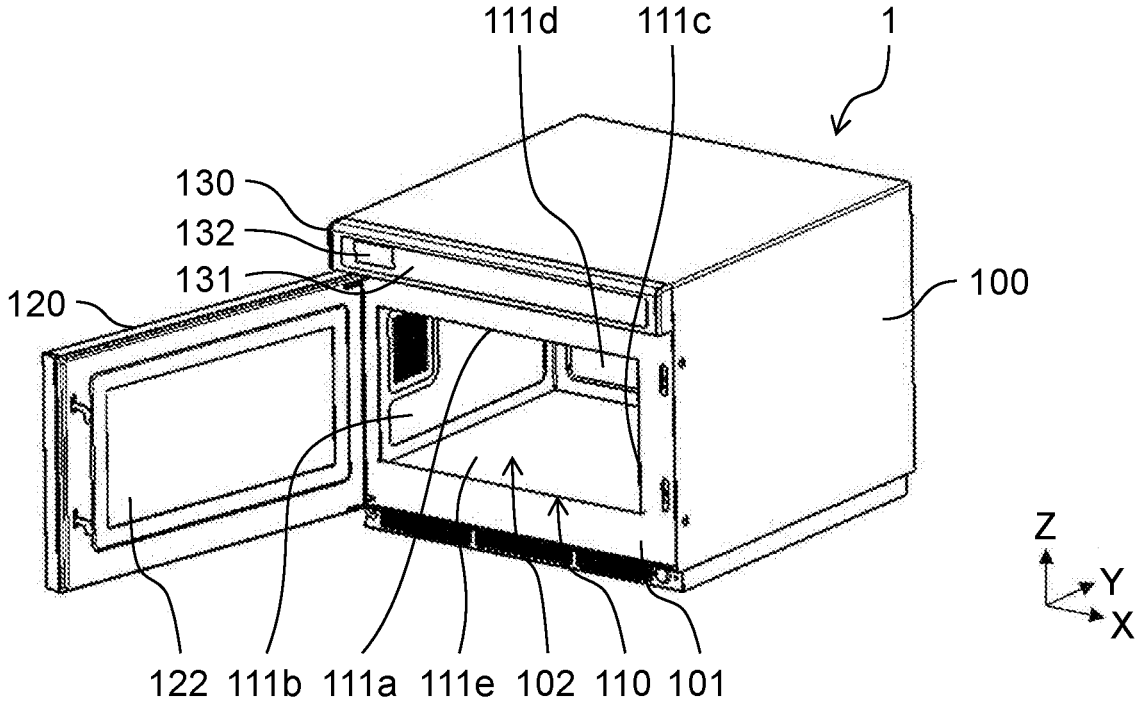
FIG. 2 is a perspective view showing the heating cooking device according to the one aspect of the present disclosure with a door opened.
Figure 3:
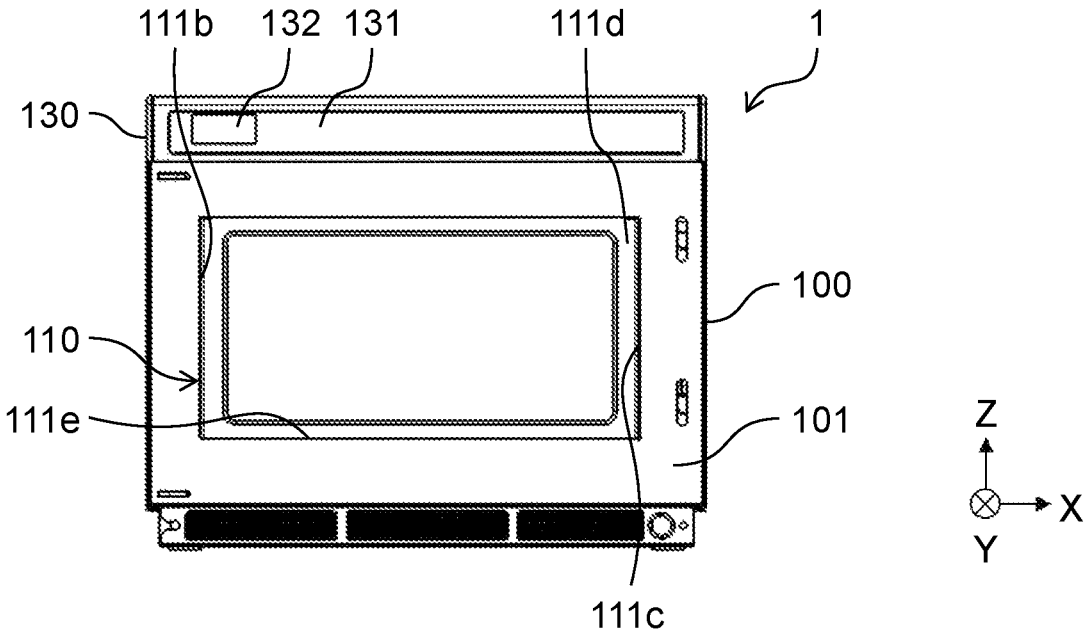
FIG. 3 is a front view showing the heating cooking device according to the one aspect of the present disclosure with the door removed.

As shown in FIGS. 1 to 3, heating cooking device 1 according to the one aspect of the present disclosure has; chassis 100; heating chamber 110 disposed in chassis 100; and door 120 openably covering front face opening 102 located on front frame 101 serving as a front face of chassis 100.

In the description of the present disclosure, a side of front face opening 102 of heating cooking device 1 is assumed to be a front side, and a back face side, which is the opposite side, is assumed to be a rear side. Further, when viewed from the front side, in other words, in a front view, a top surface side of heating cooking device 1 is assumed to be an upper side, and a bottom face side is assumed to be a lower side. Further, in the front view, a right direction from heating cooking device 1 is assumed to be a right side, and a left direction is assumed to be a left side.

In the front view of heating cooking device 1, the right direction is assumed to be X direction, and the left direction is assumed to be −X direction. A rear direction and a front direction of heating cooking device 1 are respectively assumed to be Y direction and −Y direction. An upper direction and a lower direction of heating cooking device 1 are respectively assumed to be Z direction and −Z direction.

Heating chamber 110 has: upper wall 111*a* disposed on an upper part of heating chamber 110; left-side wall 111*b* and right-side wall 111*c* each disposed on one of both parts on the right and left of heating chamber 110; back wall 111*d* disposed on a rear part of heating chamber 110; and bottom wall 111*e* disposed on a lower part of heating chamber 110. In heating chamber 110 there is formed a space.

Door 120 is attached to chassis 100 on the left side of front face opening 102 in an openable manner about a rotation center in the vertical direction. Door 120 has handle 121 on a right end part of a front surface of door 120. When handle 121 is pulled by a user, door 120 is rotationally operated, and front face opening 102 is opened. Further, when handle 121 is pushed by a user, front face opening 102 is closed. Door 120 is provided with glass window 122 through which a user can check condition in heating chamber 110.

On an upper part of the front face of chassis 100 and above door 120 there is provided operation unit 130 having a laterally elongated shape in front view. Operation unit 130 has: a plurality of operation switches 131 for a user to set how to cook; and a plurality of displays 132 to display a state of operation to a user. Operation switches 131 include buttons to choose various types of information, a start button to start cooking, and other buttons. Displays 132 display an operating state of heating cooking device 1, a state of operation by operation switches 131. Operation switches 131 and displays 132 are controlled by controller 105 (see FIGS. 5 and 6). Controller 105 may be configured with, for example, a central processing unit (CPU), a microcomputer, or a hardware logic.

Heating cooking device 1 supplies at least one of microwaves (high-frequency waves), radiation heat, hot air, and steam to the inside of heating chamber 110 to heat an object to be heated placed on a bottom part of heating chamber 110. For this purpose, heating cooking device 1 includes as a heater serving as a heating means at least one of the followings: a high-frequency wave generator including magnetrons 106*a*, 106*b* to generate microwaves (see FIGS. 7 and 8); an upper heater unit (not shown) to heat, by radiation heat, an object to be heated; a convection heater unit (not shown) to circulate hot air in heating chamber 110; and a steam generator (not shown) to generate steam in heating chamber 110. In the present disclosure, two magnetrons 106*a*, 106*b* are included as a heater, which will be described later.

Figure 4:
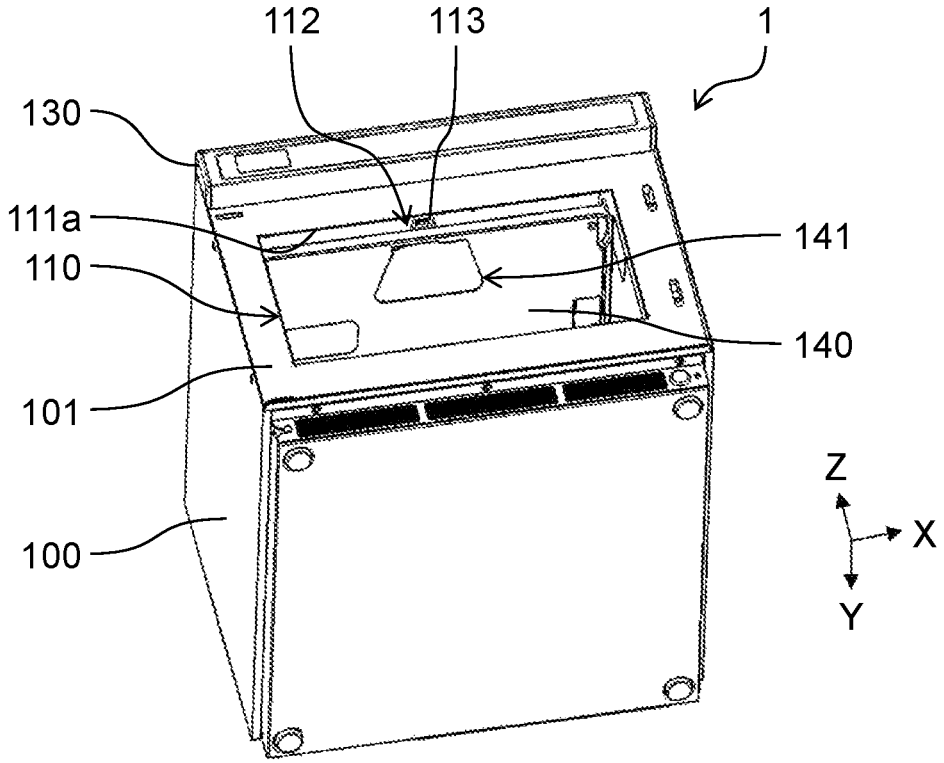
FIG. 4 is a perspective view from below showing the heating cooking device according to the one aspect of the present disclosure with the door removed.

As shown in FIG. 4, in upper wall 111*a* of heating chamber 110 of heating cooking device 1 according to the one aspect of the present disclosure, there is provided wall surface opening 112 as an opening. Wall surface depression 113 formed in a recessed shape is provided upward from a circumferential edge of wall surface opening 112. As will be described later, wall surface depression 113 is formed in a recessed shape that is narrower obliquely upward from the circumferential edge of wall surface opening 112 provided in upper wall 111*a* of heating chamber 110.

Figure 15:
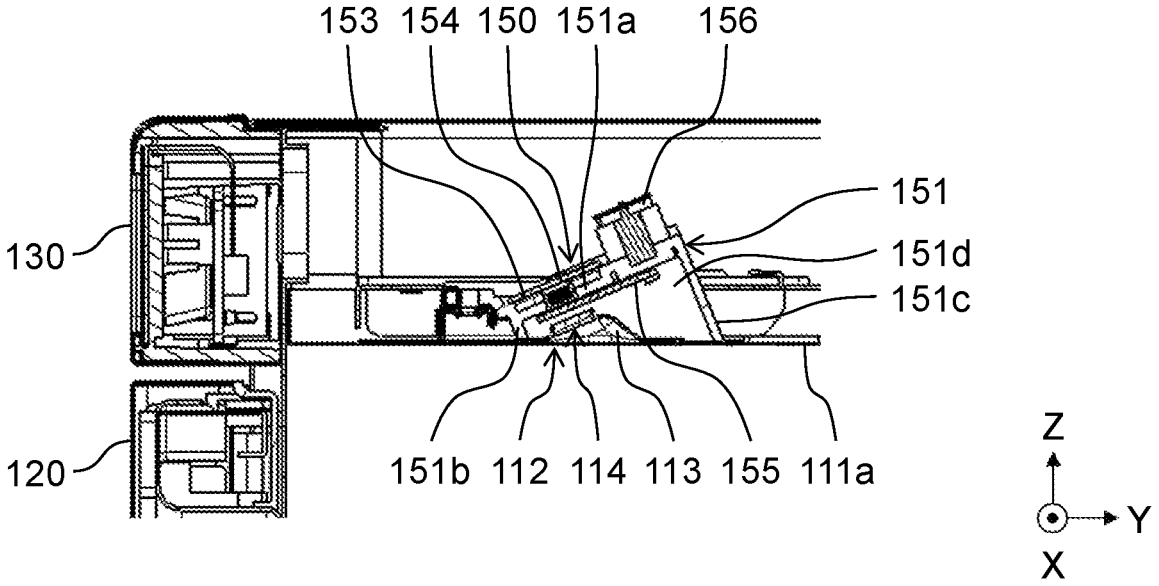
FIG. 15 is a side cross-sectional view of the main components and their surrounding area of the heating cooking device according to the one aspect of the present disclosure.

In a bottom part, in other words, on the upward side of the recessed shape of wall surface depression 113, there is formed depression bottom opening 114 that is an opening for imaging, as shown in FIG. 15. A side wall of wall surface depression 113 has a tapered shape that is narrower toward wall surface opening 112 from heating chamber 110.

Below upper wall 111*a* there is provided top panel 140 having a flat plate shape to be parallel to upper wall 111*a* with a space between top panel 140 and upper wall 111*a*. On a front side of top panel 140 there is provided top panel opening 141 as an opening.

In the following, with reference to FIGS. 5 to 11, a description will be given on a layout and the like of imaging unit 150, air blower 160, and illuminators (upper illuminator 171, left illuminator 172). Note that a right illuminator is not shown in the drawings.

Figure 5:
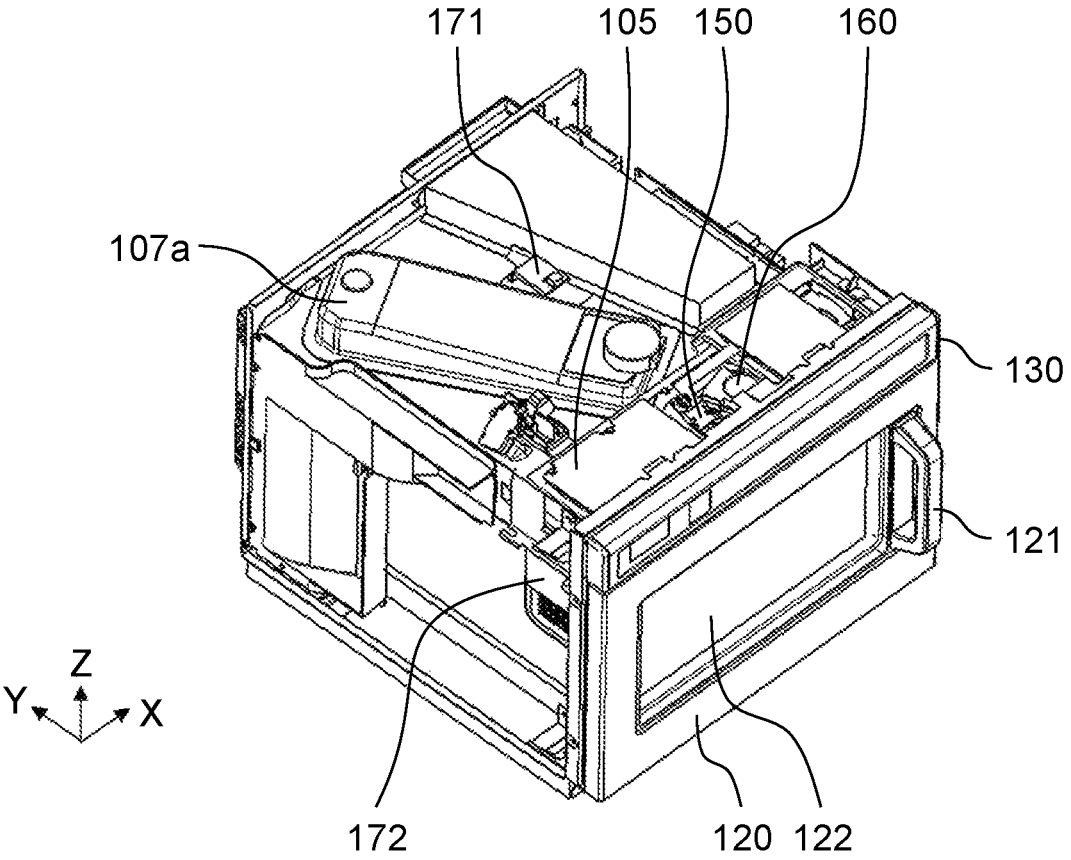
FIG. 5 is a perspective view showing the heating cooking device according to the one aspect of the present disclosure with a part of a chassis removed.
Figure 6:
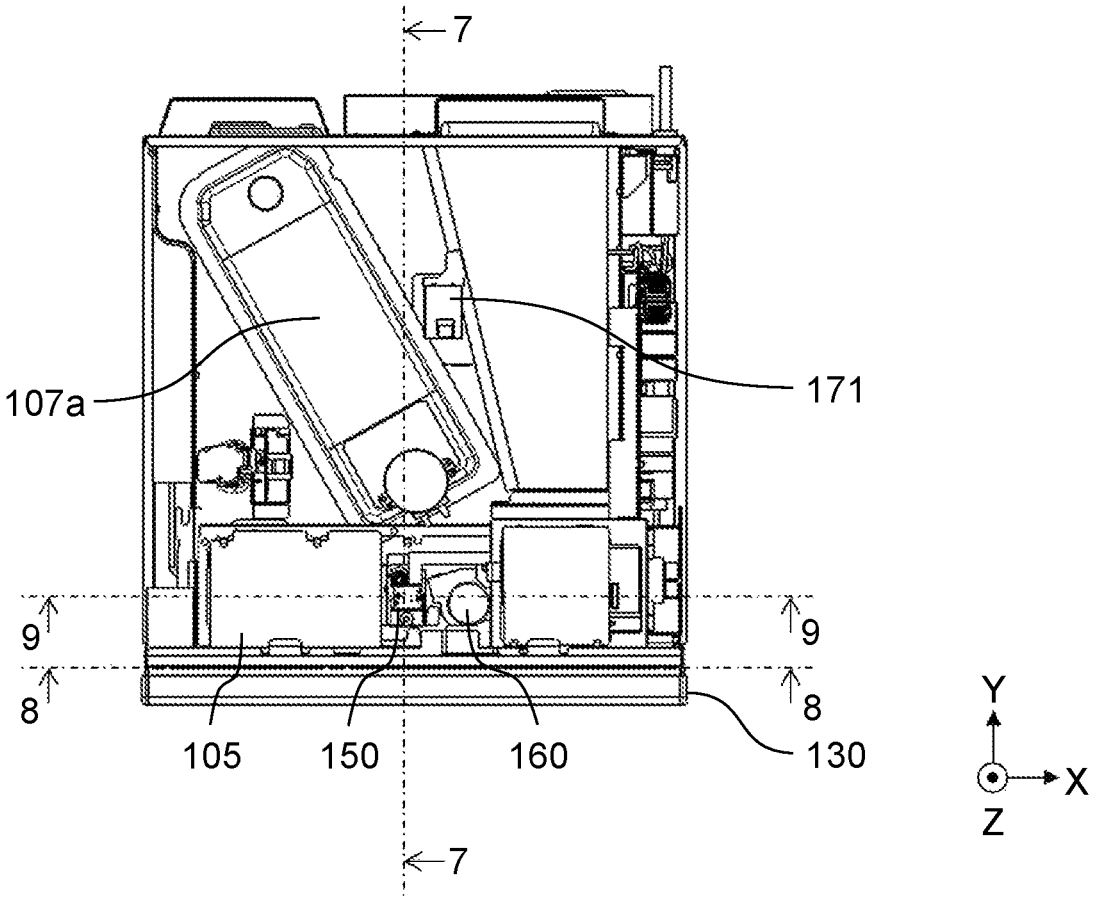
FIG. 6 is a top view showing the heating cooking device according to the one aspect of the present disclosure with a part of the chassis removed.

FIG. 5 is a perspective view showing heating cooking device 1 according to the one aspect of the present disclosure with an upper face and a side face of chassis 100 removed. FIG. 6 is a top view showing heating cooking device 1 according to the one aspect of the present disclosure with the upper face and the side face of chassis 100 removed.

Figure 7:
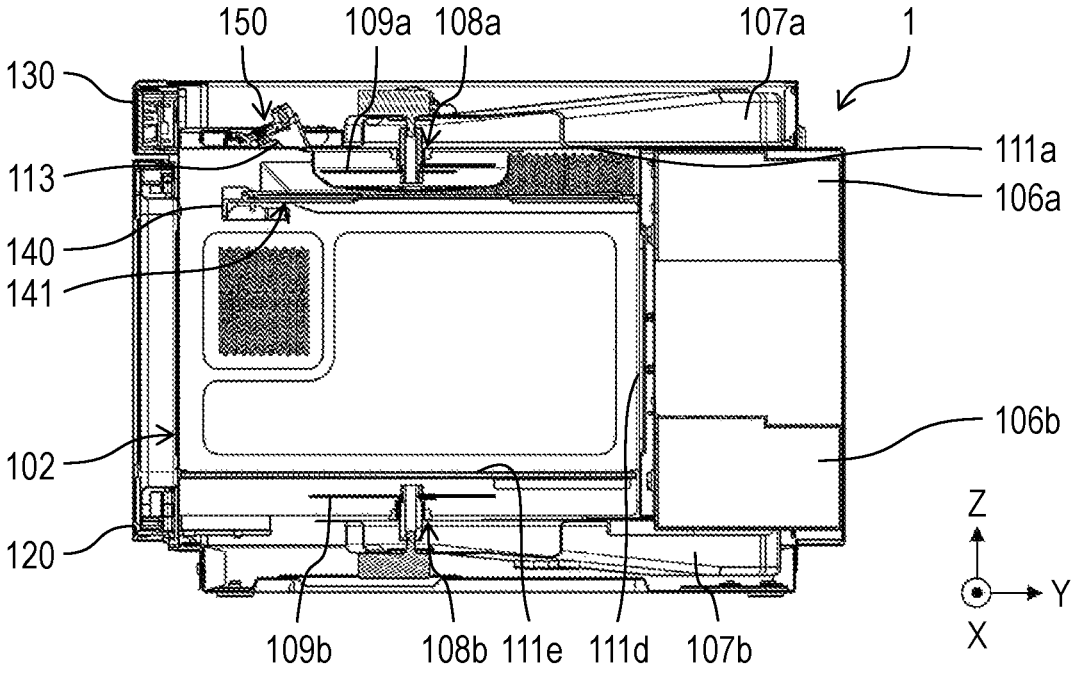
FIG. 7 is a cross-sectional view taken along line 7-7 of FIG. 6.
Figure 8:
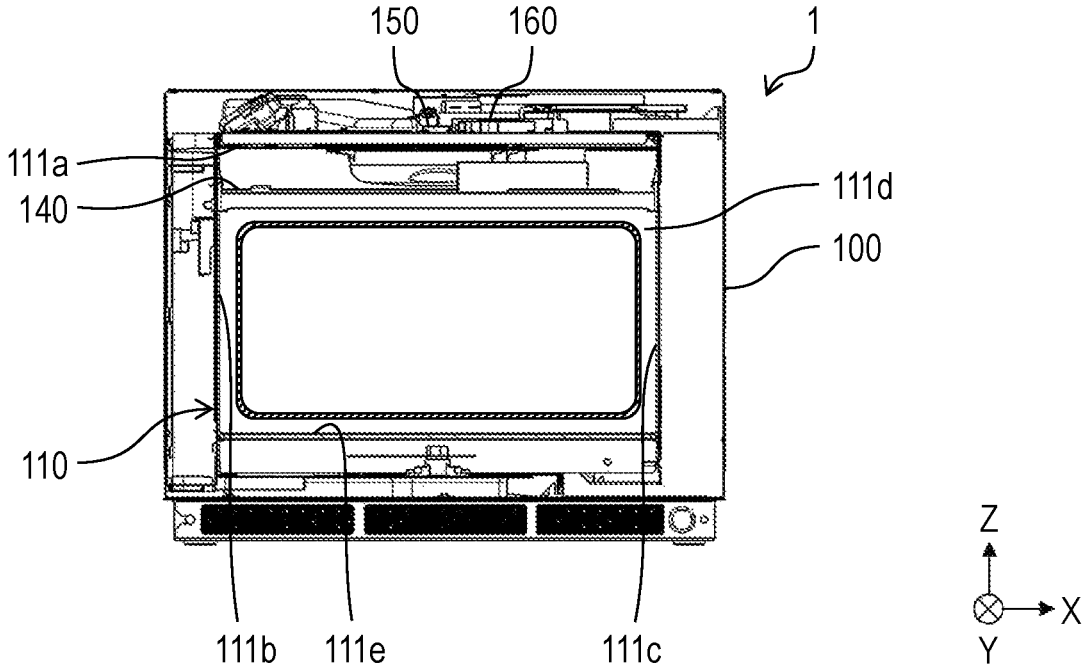
FIG. 8 is a cross-sectional view taken along line 8-8 of FIG. 6.
Figure 9:
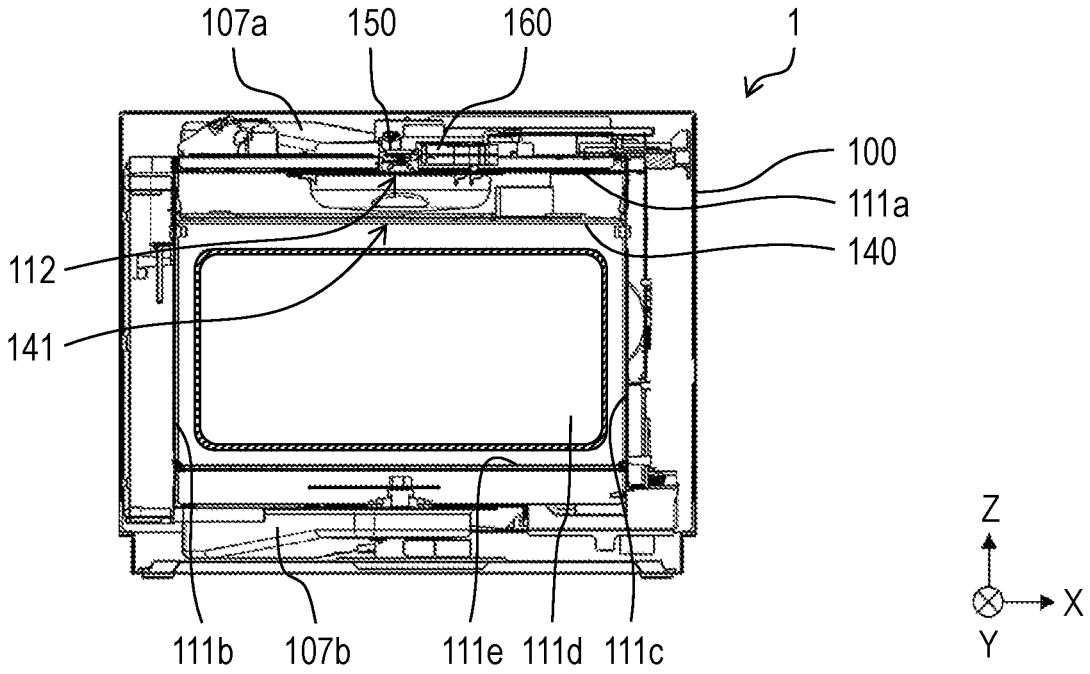
FIG. 9 is a cross-sectional view taken along line 9-9 of FIG. 6.

FIG. 7 is a cross-sectional view taken along line 7-7 of FIG. 6. FIG. 8 is a cross-sectional view taken along line 8-8 of FIG. 6. FIG. 9 is a cross-sectional view taken along line 9-9 of FIG. 6.

Figure 10:
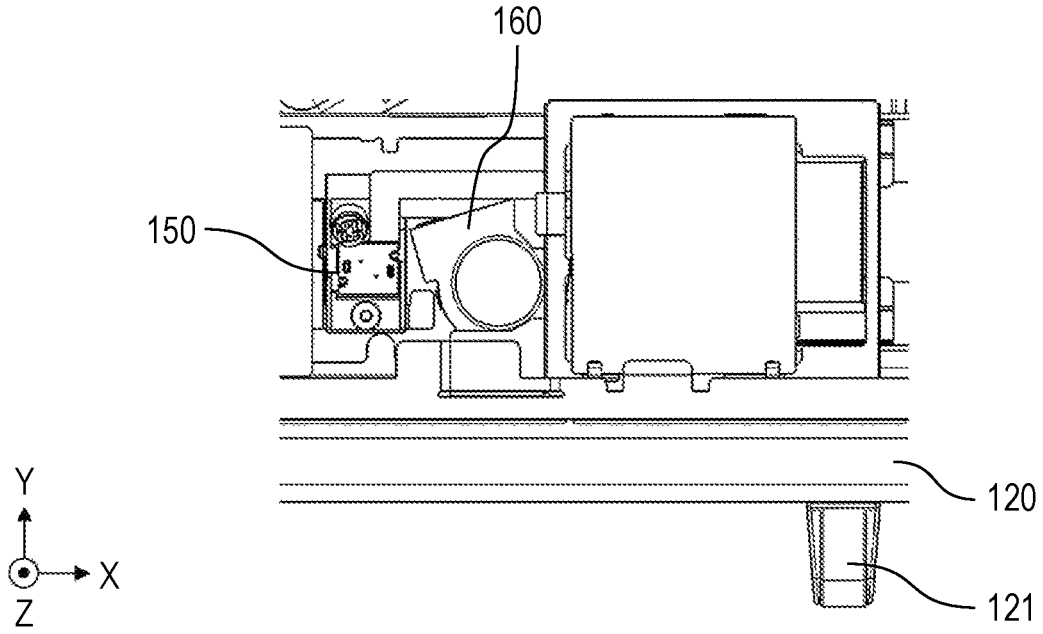
FIG. 10 is a top view of main components of the heating cooking device according to the one aspect of the present disclosure.
Figure 11:
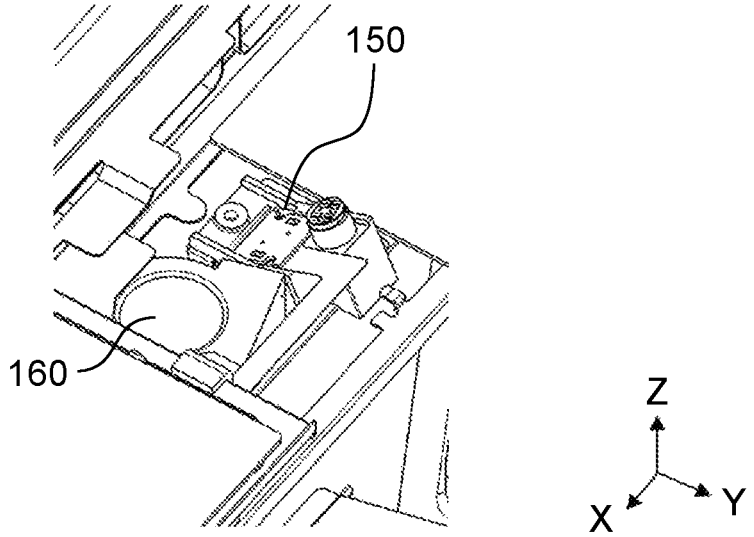
FIG. 11 is a perspective view of the main components of the heating cooking device according to the one aspect of the present disclosure.

FIG. 10 is a partially enlarged top view of a surrounding area of main components of heating cooking device 1 according to the one aspect of the present disclosure. FIG. 11 is a partially enlarged perspective view of the surrounding area of the main components of heating cooking device 1 according to the one aspect of the present disclosure.

As shown in FIGS. 5 to 9, on the rear part of heating cooking device 1, two magnetrons 106*a*, 106*b* are each provided on one of an upper part and a lower part. Magnetrons 106*a*, 106*b* are respectively connected to waveguides 107*a*, 107*b* that transfer microwaves. Upper magnetron 106*a* is connected to waveguide 107*a* provided above upper wall 111*a* of heating chamber 110. Lower magnetron 106*b* is connected to waveguide 107*b* provided below bottom wall 111*e* of heating chamber 110. Waveguide 107*a* is connected to radiation opening 108*a* formed at a center in heating chamber 110 as seen from above. Waveguide 107*b* is connected to radiation opening 108*b* formed at the center in heating chamber 110 as seen from above and below bottom wall 111*e* of heating chamber 110.

The microwaves generated by magnetrons 106*a* and 106*b* are respectively radiated from above and below into heating chamber 110 through waveguides 107*a* and 107*b* and radiation openings 108*a* and 108*b*. By radiating the microwaves from above and below, the object to be heated can be uniformly heated.

Since radiation openings 108*a*, 108*b* are disposed at the center of heating chamber 110 as seen from above, microwaves can be radiated uniformly in heating chamber 110.

Further, in the vicinities of radiation openings 108*a* and 108*b*, there are respectively provided stirrers 109*a* and 109*b* serving as antennas. Stirrers 109*a* and 109*b* respectively stir the microwaves radiated from radiation openings 108*a* and 108*b* to more uniformly heat the object to be heated.

As shown in FIGS. 5 to 11, imaging unit 150 and air blower 160 are provided above heating chamber 110.

Above and on the sides of heating chamber 110, the illuminators (upper illuminator 171 and left illuminator 172) are provided to illuminate the inside of the chamber.

As shown in FIGS. 12 to 15, imaging unit 150 has support frame 151, camera substrate 153, camera 154, shutter 155, and drive motor 156. A configuration of imaging unit 150 will be described later in detail.

Support frame 151 constituting imaging unit 150 is provided to cover wall surface depression 113 on an upper face of heating chamber 110. Imaging unit 150 is attached to face the inside of heating chamber 110 from the forward side of upper wall 111*a* of heating chamber 110, in other words, from a side that is closer to front face opening 102 than a center of upper wall 111*a* is.

Since imaging unit 150 is provided on the wall on the upper side of heating chamber 110, in other words, on the ceiling side, imaging unit 150 can capture an image at an angle and position where imaging unit 150 looks down at heating chamber 110. This arrangement makes it possible to image a state of the upper side of the object to be heated more accurately, specifically, with a high resolution and a small trapezoidal distortion.

The above configuration where an image is captured from the upper wall of heating chamber 110 is especially effective in the following usages: recognition of letters and symbols written on the upper surface of the object to be heated with high accuracy; recognition of a type of ingredient as the object to be heated; recognition of a shape and a size of the object to be heated; and recognition of a heating state of the object to be heated.

Heating cooking device 1 in the present disclosure can improve convenience of users in commercial use in convenience stores or other places and home use.

However, in the configuration where imaging unit 150 is provided on the wall surface of the upper side, there can occur an issue where imaging unit 150 is contaminated with steam and scattering substances from the object to be heated, thereby reducing imaging accuracy. A measure to deal with this issue will be described later in detail.

Imaging unit 150 is attached from the forward side of upper wall 111*a* of heating chamber 110, in other words, from a side that is closer to front face opening 102 than the center of upper wall 111*a* is. Further, imaging unit 150 is provided such that an imaging surface of camera 154 is inclined with respect to a horizontal plane such that the imaging direction is directed to an approximately central direction of bottom wall 111*e* of heating chamber 110. This arrangement makes it possible to dispose imaging unit 150 in a small space while avoiding the vicinity of the center seen from above. In the vicinity of the center, radiation opening 108*a*, which is an example of the heater and radiates microwaves, and other components are disposed. Further, although the vicinity of the center is avoided, it is possible to image the entire inside of heating chamber 110 with high accuracy.

Since imaging unit 150 is provided with the imaging direction inclined backward with respect to the vertical direction, it is possible to prevent or reduce an influence, on imaging by imaging unit 150, caused by external light entering through glass window 122 of door 120. Specifically, it is possible to prevent deterioration of imaging accuracy of camera 154 caused by external light having entered through glass window 122 being directly or indirectly superposed with high luminance on an image captured by camera 154.

Figure 17:
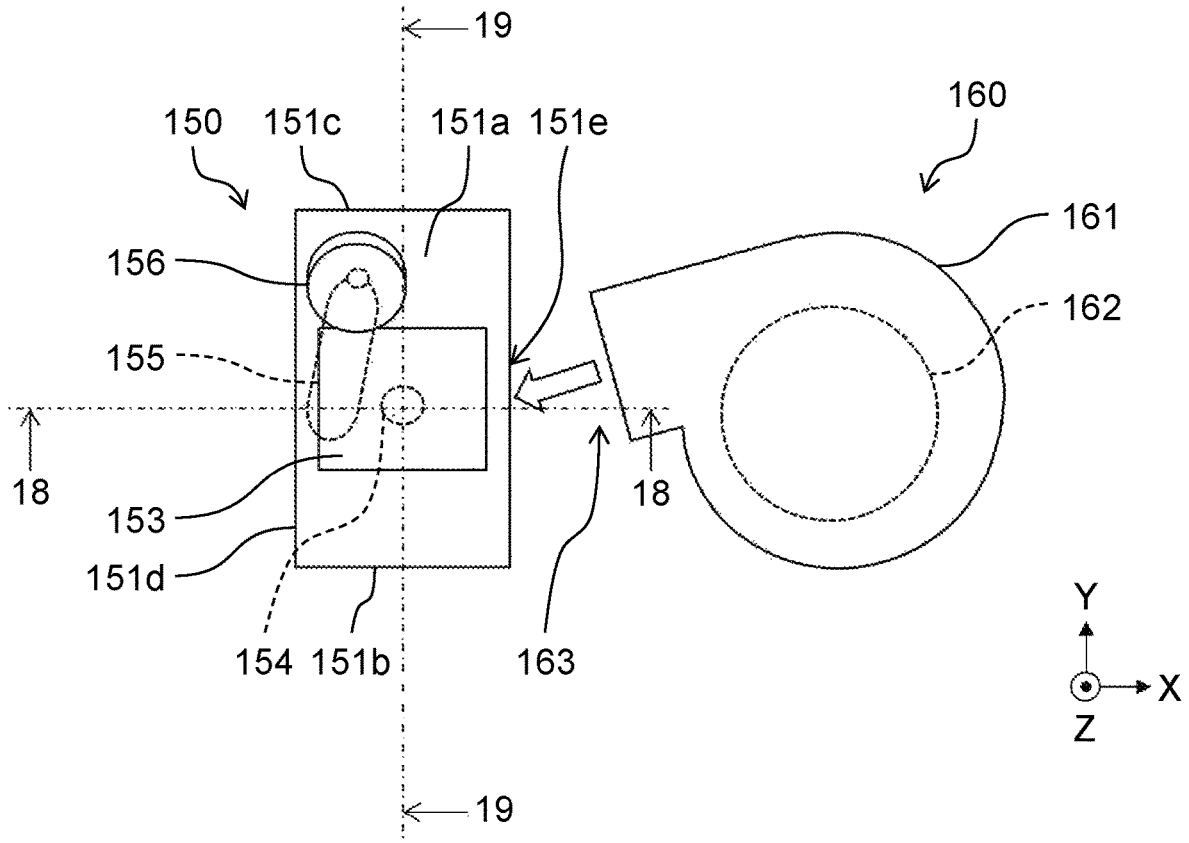
FIG. 17 is an explanatory diagram illustrating an air path of the heating cooking device according to the one aspect of the present disclosure.

Air blower 160 has fan case 161, fan 162, and exhaust port 163 as shown in FIG. 17. Details will be described later.

In fan case 161, fan 162 is provided. The fan case has exhaust port 163 to blow air. Fan 162 is driven by a DC motor (not shown) to generate airflow to be blown. Fan 162 is driven on the basis of an instruction from controller 105.

Figure 16:
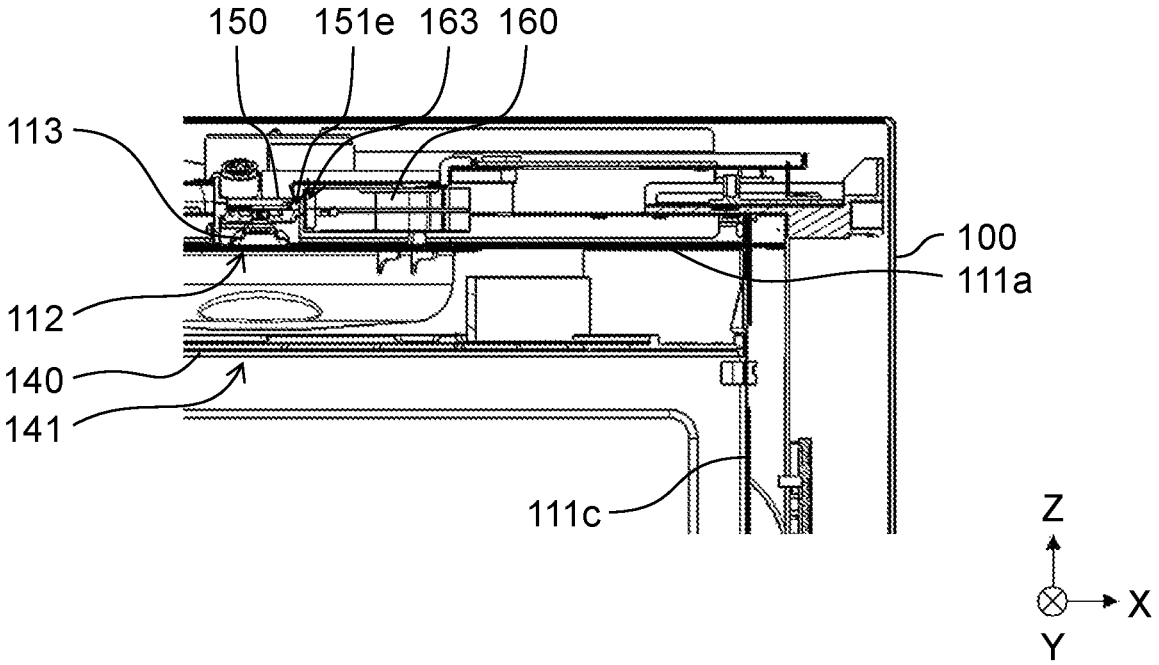
FIG. 16 is a front cross-sectional view of the main components and their surrounding area of the heating cooking device according to the one aspect of the present disclosure.

Air blower 160 is provided at a position of a front part of upper wall 111*a* of heating chamber 110 and at a position on the right or left of imaging unit 150. Although will be described later, as shown in FIG. 16, exhaust port 163 of air blower 160 and inlet port 151*e* of imaging unit 150 are provided to face each other in the right-left direction. That is, air is blown from air blower 160 to imaging unit 150 approximately along the right-left direction. Since air blower 160 is disposed as described above, air blower 160 can be disposed in a small space above upper wall 111*a* of heating chamber 110 while avoiding the vicinity of the center seen from above. In the vicinity of the center of upper wall 111*a*, radiation opening 108*a*, which is an example of the heater and radiates microwaves, and other components are disposed.

Since exhaust port 163 of air blower 160 and inlet port 151*e* of imaging unit 150 are provided to face each other, air can be blown from air blower 160 to imaging unit 150 in a more linear manner. This arrangement prevents pressure loss due to a curved air path and enables air to be strongly blown to imaging unit 150.

Fan 162 is provided in fan case 161 to have a rotation axis in the vertical direction. This configuration enables fan case 161 to be disposed in the horizontal direction in such a manner that a main surface of fan case 161 is along upper wall 111*a* of heating chamber 110. As a result, air blower 160 can be disposed in a space-saving manner also in the vertical direction.

Upper illuminator 171, left illuminator 172, and the right illuminator each have a light emitting diode (LED) as a light emitting element.

Upper illuminator 171 is disposed such that a light emitting direction is directed to the inside of heating chamber 110 and an object to be heated in heating chamber 110 is illuminated. Light emission of upper illuminator 171, left illuminator 172, and the right illuminator constituting the illuminators is controlled on the basis of an instruction from controller 105.

Upper illuminator 171 is disposed on the rear side with respect to the center of upper wall 111*a* of heating chamber 110 as seen from above. As seen from above, upper illuminator 171 and imaging unit 150 are disposed at opposite positions with respect to waveguide 107*a*, which is disposed to be inclined with respect to a front-back direction. Upper illuminator 171 and imaging unit 150 are disposed at opposite positions with respect to radiation opening 108*a* as seen from above. This arrangement makes it possible to dispose upper illuminator 171, which constitutes the illuminators, in a small space while avoiding the vicinity of the center seen from above, where various components are disposed.

Configuration of Main Part

With reference to FIGS. 12 to 16, a detailed description will be given to imaging unit 150 and air blower 160 and a surrounding area of imaging unit 150 and air blower 160.

Figure 12:
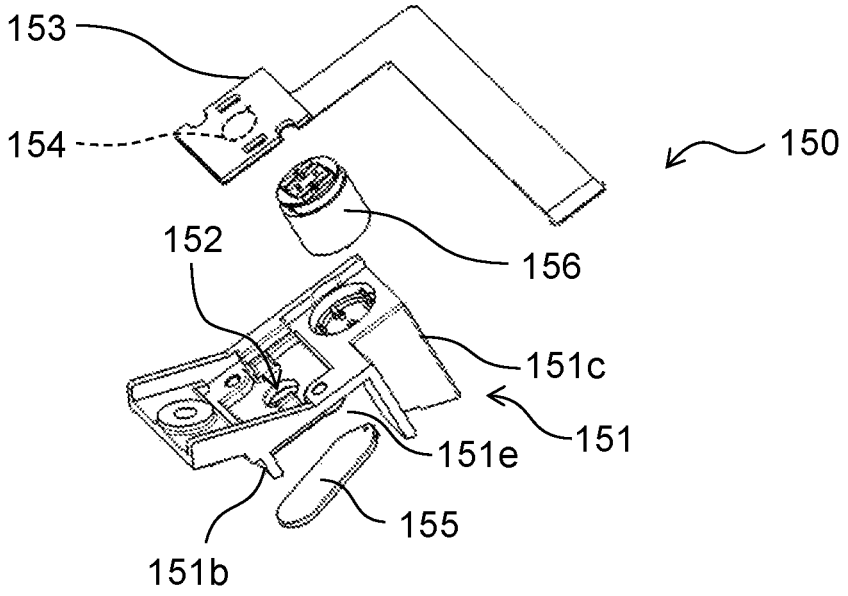
FIG. 12 is an exploded perspective view of an imaging unit of the heating cooking device according to the one aspect of the present disclosure.
Figure 13:
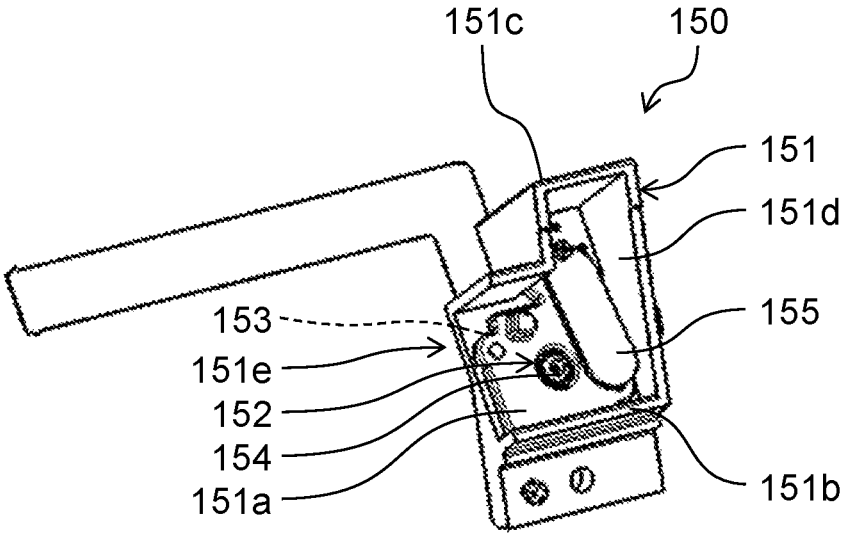
FIG. 13 is a perspective view from below of the imaging unit of the heating cooking device according to the one aspect of the present disclosure.
Figure 14:
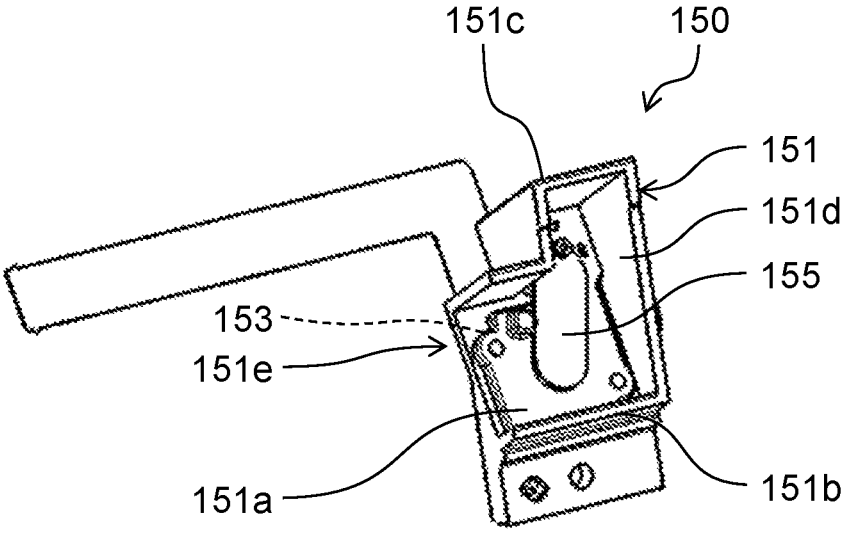
FIG. 14 is a perspective view from below of the imaging unit of the heating cooking device according to the one aspect of the present disclosure.

FIG. 12 is an exploded perspective view of imaging unit 150. FIGS. 13 and 14 are each a perspective view from below of imaging unit 150. As will be described later, FIG. 13 shows shutter 155 at an open position, and FIG. 14 shows shutter 155 at a closed position. FIG. 15 is an enlarged view of the surrounding area of imaging unit 150 in FIG. 7. FIG. 16 is an enlarged view of the surrounding area of imaging unit 150 in FIG. 9.

Imaging unit 150 has support frame 151, camera substrate 153, camera 154, shutter 155, and drive motor 156.

Support frame 151 constituting a frame body of imaging unit 150 is formed of resin. Support frame 151 can therefore support camera substrate 153 while sufficiently insulating camera substrate 153 and, can set the imaging direction of camera 154 with high accuracy.

Support frame 151 supports camera substrate 153, shutter 155, and drive motor 156 and, at the same time, constitutes first air path 200 (see FIGS. 18 and 19) serving as an air path that guides an airflow from air blower 160. First air path 200 will be described later in detail.

Support frame 151 has upper wall 151*a*, front-side wall 151*b*, rear-side wall 151*c*, and left-side wall 151*d*.

A main part of upper wall 151*a* has an approximately rectangular plate shape to constitute the upper-side wall of support frame 151. At a central part of upper wall 151*a*, there is formed imaging opening 152 for capturing an image.

Front-side wall 151*b* and rear-side wall 151*c* are disposed to face each other and constitutes side walls to support upper wall 151*a* on the front side and the rear side. In the present disclosure, front-side wall 151*b* is formed to have a height lower than a height of rear-side wall 151*c*.

With this arrangement, when support frame 151 is attached to upper wall 111*a* of heating chamber 110, upper wall 151*a* of support frame 151 is disposed to be inclined such that upper wall 151*a* is lower on a front-side wall 151*b* side with respect to upper wall 111*a* of heating chamber 110.

Left-side wall 151*d* constitutes a side wall on a left side of support frame 151. The side, of support frame 151, facing left-side wall 151*d* is opened and forms inlet port 151*e* as will be described later.

Support frame 151 is fixed with a lower end part of each of front-side wall 151*b*, rear-side wall 151*c*, and left-side wall 151*d* in contact with an upper surface of upper wall 111*a* of heating chamber 110.

Upper wall 151*a*, front-side wall 151*b*, and rear-side wall 151*c* of support frame 151 and upper wall 111*a* of heating chamber 110 form inlet port 151*e* serving as an opening on the side, of support frame 151, facing left-side wall 151*d* of support frame 151. Inlet port 151*e* is an inlet port to take air into support frame 151. Inlet port 151*e* of support frame 151 is disposed to face exhaust port 163 of fan 162.

Camera substrate 153 has an approximately rectangular flat plate shape, and camera 154 is attached at a center of a surface, of camera substrate 153, directed downward when support frame 151 is installed on upper wall 111*a* of heating chamber 110.

An imaging surface of camera 154 is formed in an approximately circular shape. As an imaging element (not shown) of camera 154, a charge coupled device (CCD) or a complementary metal-oxide silicon (CMOS) device is used, for example. On an imaging direction side of the imaging element, there is provided a condenser lens (not shown). Camera 154 captures an image of the inside of heating chamber 110, on the basis of an instruction from controller 105.

Camera substrate 153 is attached to support frame 151 in such a manner that the imaging direction of camera 154 faces the inside of heating chamber 110. Camera substrate 153 is attached to support frame 151 in such a manner that camera 154 is fit in imaging opening 152 of support frame 151.

Camera substrate 153 is attached to support frame 151 in such a manner that imaging opening 152 of support frame 151, depression bottom opening 114 of wall surface depression 113, and wall surface opening 112 of upper wall 111*a* are disposed in line in the imaging direction of camera 154, in other words, the optical axis of camera 154.

This arrangement enables camera 154 to face the inside of heating chamber 110 and to thus capture an image of the inside of heating chamber 110.

On upper wall 151*a* of support frame 151, shutter 155 and drive motor 156 are provided.

Shutter 155 is a member that openably closes or opens the imaging surface of camera 154. Shutter 155 is rotatably attached to a surface on the lower side of upper wall 151*a* of support frame 151. Further, shutter 155 is provided to be able to cover camera 154 in the imaging direction of camera 154 and on a side of camera 154 facing heating chamber 110.

Shutter 155 is a flat plate having an approximate rectangle shape, and both ends in a longitudinal direction are each formed in a circular arc shape.

Shutter 155 rotates between the open position and the closed position along a surface of upper wall 151*a* of support frame 151, using a rotation shaft on an upper side in the longitudinal direction as a rotation center. Shutter 155 is formed of resin.

In this exemplary embodiment, the open position is a position where shutter 155 does not cover imaging opening 152 of support frame 151 as shown in FIG. 13.

The closed position is a position where shutter 155 covers imaging opening 152 of support frame 151 as shown in FIG. 14.

Shutter 155 closes imaging opening 152 at the closed position, so that camera 154 can be protected. Further, shutter 155 opens imaging opening 152 at the open position, so that camera 154 can capture an image of the inside of heating chamber 110.

Figure 18:
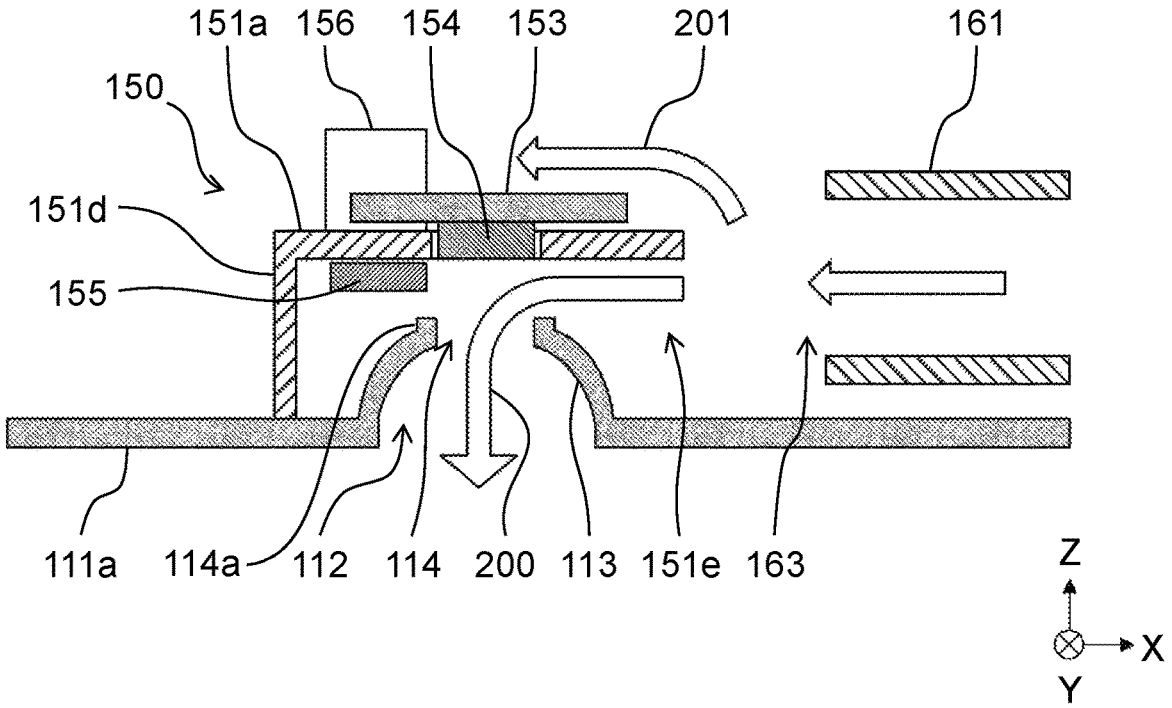
FIG. 18 is a cross-sectional view taken along line 18-18 of FIG. 17.

In the present disclosure, the open position is closer to left-side wall 151*d* of support frame 151 than camera 154 is. That is, as shown in FIG. 18, shutter 155 at the open position is located on a downstream side in the first air path 200 with respect to camera 154. With such a configuration, even when an airflow is generated in first air path 200, shutter 155 moves without moving against the airflow, and shutter 155 can therefore be stably opened.

Shutter 155 is disposed on a flat plane substantially in close contact with camera 154 in the imaging direction of camera 154. Specifically, at the closed position, shutter 155 can surely protect camera 154 from scattering substances such as steam and oil.

The rotation shaft of shutter 155 is disposed on the upward side with respect to camera 154 on upper wall 151*a* of support frame 151. This arrangement enables shutter 155 to rotate with low energy and high reliability. Drive motor 156 is attached to an upper side surface of upper wall 151*a* of support frame 151.

A rotation shaft of drive motor 156 is coupled to the rotation shaft of shutter 155. This arrangement enables operation of drive motor 156 to rotate shutter 155. Drive motor 156 rotates to open and close shutter 155 on the basis of an instruction from controller 105.

Drive motor 156 holds the state at each of the closed position and the open-close position by magnetic force in drive motor 156. This configuration can prevent or reduce generation of noise compared with a method where the states are held by using a solenoid that requires electricity to hold. It is therefore possible to prevent or reduce deterioration of imaging accuracy due to noise generated in a captured image.

Drive motor 156 is a heating body because drive motor 156 performs motor driving. Drive motor 156 and camera 154 are disposed to face vertically opposite directions with respect to upper wall 151*a* of support frame 151. With this arrangement, it is possible to prevent or reduce influence that heat generated by drive motor 156 gives to camera 154.

Since drive motor 156 is attached to the upper side surface of upper wall 151*a* of support frame 151, support frame 151 can be disposed in a space where the surrounding area of support frame 151 is small as seen from above.

Drive motor 156 is attached to upper wall 151*a* of support frame 151, which is inclined in the front-back direction. That is, drive motor 156 is attached such that the rotation shaft of drive motor 156 is inclined with respect to the vertical direction of heating cooking device 1. This arrangement enables drive motor 156 to be disposed in a small space also in the vertical direction.

Drive motor 156 is disposed on upper wall 151*a* of support frame 151, where camera 154 is disposed. That is, drive motor 156 is disposed such that the rotation shaft of drive motor 156 is perpendicular to camera 154. This arrangement enables the imaging surface of camera 154 to be precisely disposed substantially parallel to shutter 155 coupled to drive motor 156.

As shown in FIGS. 15 and 16, in upper wall 111*a* of heating chamber 110, wall surface opening 112 is provided as an opening. Further, wall surface depression 113 is provided to cover wall surface opening 112. In a bottom part, in other words, on the upward side of the recessed shape of wall surface depression 113, there is formed depression bottom opening 114 that is an opening for imaging.

The side wall of wall surface depression 113 has a tapered shape that becomes narrower from a side of heating chamber 110 toward a side of depression bottom opening 114. Depression bottom opening 114 is disposed to face the vicinity of camera 154. A cross-sectional area of an opening plane of depression bottom opening 114 is smaller than a cross-sectional area of an opening plane of wall surface opening 112. By making an area of the opening plane of depression bottom opening 114 smaller as described above, it is possible to prevent or reduce leakage of microwaves from the inside of heating chamber 110 to the outside of heating chamber 110.

Wall surface depression 113 further has, on a surrounding edge of depression bottom opening 114, protrusion 114*a* directed above and having a ring shape (see FIG. 18). This arrangement can further prevent or reduce the leakage of microwaves from heating chamber 110 to the outside of heating chamber 110.

Since depression bottom opening 114 is disposed in the vicinity of camera 154 and the opening plane of wall surface opening 112 has a greater cross-sectional area than the depression bottom opening 114, camera 154 can capture an image of the inside of heating chamber 110 with a wider angle.

Action

In the following, with reference mainly to FIGS. 17 to 19, action of heating cooking device 1 of the present disclosure will be described below.

FIG. 17 is a top view schematic diagram for illustrating imaging unit 150 and air blower 160.

FIG. 18 is a cross-sectional view taken along line 18-18 of FIG. 17 and illustrates first air path 200 and second air path 201.

Figure 19:
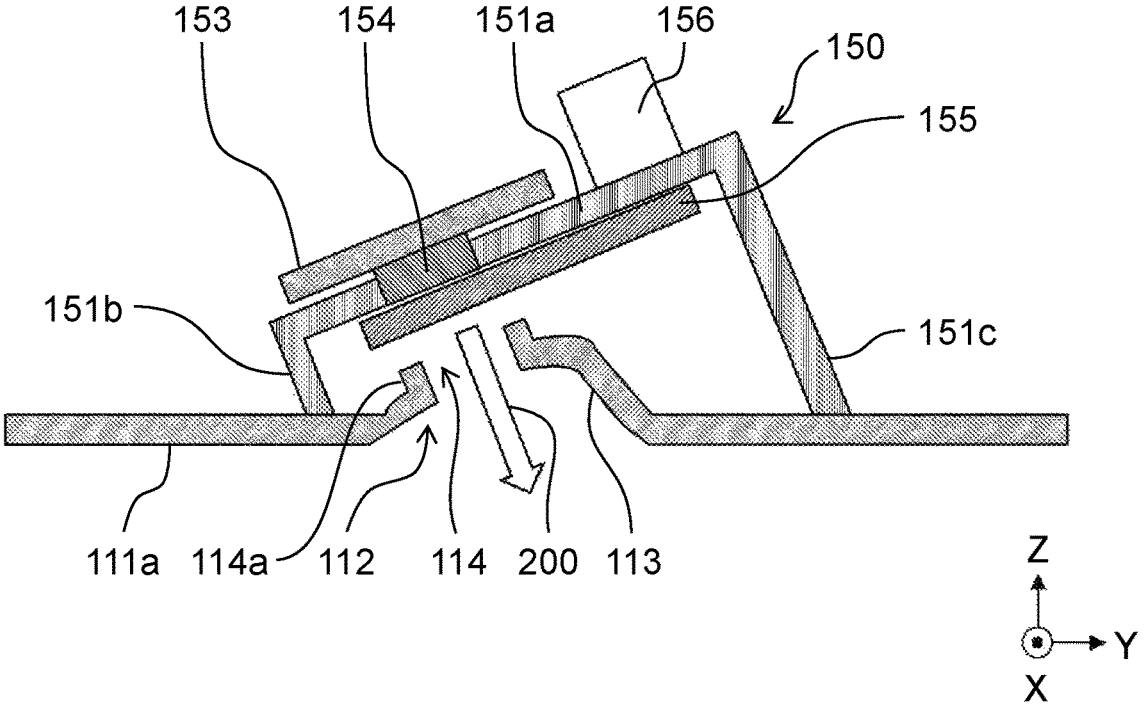
FIG. 19 is a cross-sectional view taken along line 19-19 of FIG. 17.

FIG. 19 is a cross-sectional view taken along line 19-19 of FIG. 17 and illustrates first air path 200 and second air path 201.

In the following, first air path 200 and second air path 201 will be described.

Support frame 151, upper wall 111*a* of heating chamber 110, and wall surface depression 113 constitute first air path 200 serving as an airflow path.

First air path 200 is an air path having the following structure: inlet port 151*e* of support frame 151 serves as an inlet port; the air path passes through a space constituted by an inside of support frame 151 and upper wall 111*a* of heating chamber 110, and passes through a space inside wall surface depression 113 via depression bottom opening 114; and wall surface opening 112 serves as an exhaust port. That is, first air path 200 is an air path that discharges air taken in through inlet port 151*e*, toward the inside of heating chamber 110 through wall surface opening 112 by way of the vicinity of camera 154. As described above, first air path 200 bends the airflow in the right-left direction of heating chamber 110 to a downward direction of heating chamber 110.

Second air path 201 is an air path that is outside first air path 200 and flows along an upper side of upper wall 151*a* of support frame 151. Specifically, second air path 201 is an air path passing through a surface of camera substrate 153 on which camera 154 is not installed, and the vicinity of drive motor 156.

A cross-sectional area of an opening plane of inlet port 151*e* of imaging unit 150 is smaller than a cross-sectional area of an opening plane of exhaust port 163 of air blower 160. This arrangement enables a single air blower (air blower 160) to blow air for two air paths (first air path 200 and second air path 201).

The cross-sectional area becomes smaller in the following order: the cross-sectional area of the opening of exhaust port 163 of air blower 160; the cross-sectional area of the opening of inlet port 151*e* of support frame 151; and the cross-sectional area of the opening of depression bottom opening 114. The above three openings along a flow path direction of first air path 200 are formed such that the cross-sectional area becomes smaller in order toward the downstream. This arrangement enables the airflow blown from air blower 160 to flow from the vicinity of imaging unit 150 toward the inside of heating chamber 110 at an increased speed. It is therefore possible to more surely protect imaging unit 150 from the steam and the scattering substances coming to imaging unit 150.

Air blower 160 makes fan 162 rotate on the basis of an instruction from controller 105. The rotation of fan 162 generates an airflow from exhaust port 163 of air blower 160.

Part of the airflow discharged from exhaust port 163 flows into inlet port 151*e*, which is an inlet port of first air path 200. The rest of the airflow flows toward second air path 201, which is the outside of first air path 200.

The airflow having flown into the inside of support frame 151 flows toward camera 154 and shutter 155, being guided by upper wall 151*a*, front-side wall 151*b*, and rear-side wall 151*c* of support frame 151.

When shutter 155 is located at the open position, part of the airflow having flown in flows along a surface of shutter 155 and the imaging surface of camera 154. When shutter 155 is located at the closed position, part of the airflow having flown in flows along the surface of shutter 155. These airflows can protect the imaging surface of camera 154 and the surface of the shutter from the scattering substances such as steam and oil generated from the object to be heated.

The airflow having flown into first air path 200 turns downward in the vicinity of camera 154 and flows to wall surface depression 113 through depression bottom opening 114. The airflow having flown into wall surface depression 113 is discharged into heating chamber 110 through wall surface opening 112.

As described above, after the airflow having flown into support frame 151 from inlet port 151*e* of first air path 200 forms an airflow flowing along camera 154 and shutter 155, the airflow turns to the heating chamber 110 side, in other words, to the imaging direction side of camera 154, and flows into heating chamber 110.

As described above, the airflow flowing from a side of camera 154 toward a side of heating chamber 110 can prevent or reduce the scattering substances such as steam and oil flying toward camera 154 and shutter 155. Further, the airflow flowing along the surfaces of camera 154 and shutter 155 can protect and clean the surfaces of camera 154 and shutter 155. Further, the airflow flowing from the side of camera 154 toward the side of heating chamber 110 can dissipate scattering substances such as steam in the imaging direction, so that the view of camera 154 is made clearer. Further, the airflow flowing along the imaging surface of camera 154 can cool camera 154. Due to the above functions, imaging unit 150 can capture an image of the inside of heating chamber 110 more accurately.

Shutter 155 is located in first air path 200, which is above upper wall 111*a* of heating chamber 110, and the airflow in first air path 200 flows on the side of heating chamber 110 with respect to shutter 155. In other words, an air path is formed between upper wall 111*a* of heating chamber 110 and shutter 155. Therefore, shutter 155 in addition to camera 154 is also protected from scattering substances such as steam and oil. This arrangement can prevent or reduce deterioration of reliability in operation due to shutter 155, which is a movable member, being contaminated.

The airflow flowing toward second air path 201 flows toward the surface of camera substrate 153 on which camera 154 is not installed and toward drive motor 156 while flowing along the upper side of upper wall 151*a* of support frame 151. This arrangement makes it possible to cool camera 154 and camera substrate 153, which are configured with heat-sensitive semiconductor elements. It is therefore possible to capture images highly reliably. Further, since it is possible to cool drive motor 156, which has a coil for motor and is a heating body, it is possible to prevent or reduce malfunction of the motor caused by high temperatures. As a result, shutter 155 can be opened and closed more highly reliably.

In the following, an imaging operation of imaging unit 150 will be described.

At a time of imaging, air blower 160 is rotating fan 162 on the basis of an instruction from controller 105. However, controller 105 may rotate fan 162 since immediately before imaging or may rotate fan 162 continuously while imaging is not performed.

Imaging unit 150 rotates drive motor 156 on the basis of an instruction from controller 105. This rotation makes shutter 155 rotate to the open position as shown in FIGS. 13 and 18. At this time, the imaging surface of camera 154 is exposed to heating chamber 110. However, air blower 160 and first air path 200 form the airflow flowing from camera 154 toward heating chamber 110. It is therefore possible to prevent camera 154 from being contaminated with the steam and the scattering substances from the object to be heated.

Camera 154 images heating chamber 110 on the basis of an instruction from controller 105. After the imaging, drive motor 156 is made to rotate shutter 155 to the closed position shown in FIG. 14, on the basis of an instruction from controller 105. This operation makes the imaging surface of camera 154 be closed from heating chamber 110. It is therefore possible to more surely prevent the imaging surface of camera 154 from being contaminated with the steam and the scattering substances from the object to be heated. Also in the case where fan 162 is stopped and there is no airflow in first air path 200, the imaging surface of camera 154 can be surely prevented from being contaminated.

In addition to the imaging surface of camera 154, the airflow in first air path 200 passes through surfaces in a surrounding area of the upper and lower sides of shutter 155 and the rotation shaft. This can prevent or reduce contamination of shutter 155, which is a movable member. This can improve reliability of an open and close operation of shutter 155, which is a movable member.

Other Exemplary Embodiments

As described above, the above exemplary embodiment has been described as an example of the techniques disclosed in the present application. However, the techniques of the present disclosure can be applied not only to the above exemplary embodiment but also to exemplary embodiments in which modification, replacement, addition, or removal is appropriately made.

Therefore, other exemplary embodiments will be exemplified below.

In the above exemplary embodiment, air blower 160 is disposed on the right side with respect to imaging unit 150. However, air blower 160 may be disposed on the left side with respect to imaging unit 150.

In the above exemplary embodiment, the height of front-side wall 151*b* of support frame 151 is formed to be lower than the height of rear-side wall 151*c*. However, the height of front-side wall 151*b* may be formed to be the same as the height of rear-side wall 151*c*. Further, the height of front-side wall 151*b* may be formed to be higher than the height of rear-side wall 151*c*. However, camera 154 needs to be disposed on support frame 151 in such a manner that camera 154 can capture a wide image of heating chamber 110.

In the disclosed embodiment, support frame 151 has front-side wall 151*b*, and support frame 151 is fixed with a lower end part of front-side wall 151*b* in contact with upper wall 111*a* of heating chamber 110. However, support frame 151 may not have front-side wall 151*b*, and support frame 151 may be fixed with one end of upper wall 111*a* of support frame 151 in contact with upper wall 111*a* of heating chamber 110.

In the disclosed embodiment, support frame 151 is fixed to be directly in contact with upper wall 111*a* of heating chamber 110. However, support frame 151 may be fixed on upper wall 111*a* of heating chamber 110 through a support member such as a base.

In the above exemplary embodiment, shutter 155 is configured in a rotation type, where shutter 155 rotates along the imaging surface. However, the shutter may be configured in a reciprocation type, where the shutter reciprocally moves along the imaging surface. Alternatively, the shutter may be configured in a swing door type, where the rotation axis is parallel to the imaging surface.

As drive motor 156 to open and close shutter 155, a rotation type DC motor is used. However, a linear motor, for example, may be used if the motor can open and close the shutter.

The above exemplary embodiment describes a configuration where second air path 201 is provided on the downstream side of air blower 160. However, exhaust port 163 of air blower 160 and inlet port 151*e* of support frame 151 may be directly connected without providing any branch path on the air path. Specifically, second air path 201 may not be provided.

In the described configuration, there is a space between exhaust port 163 of air blower 160 and inlet port 151*e* of support frame 151. However, an air path may be formed to directly connect exhaust port 163 of air blower 160 and inlet port 151*e* of support frame 151.

In the above exemplary embodiment, the configuration is made such that the air blown from air blower 160 toward imaging unit 150 flows in the right-left direction as seen from above. However, in a configuration where the heater is not disposed in the vicinity of the approximate center seen from above of upper wall 111*a*, the configuration may be made such that the blown air flowing from air blower 160 toward imaging unit 150 flows in a direction other than the right-left direction seen from above.

As described above, a heating cooking device according to one aspect of the present disclosure includes: a heating chamber having a front face opening; a heater that is provided on an upper wall of the heating chamber to heat an object to be heated stored in the heating chamber, at least part of the heater being disposed at an approximate center of the heating chamber seen from above. The heating cooking device further includes a camera that is provided on the upper wall of the heating chamber and is disposed closer to a front of the heating chamber than the center of the heating chamber is when seen from above, with the camera having an imaging direction inclined toward a rear side of the heating chamber with respect to a vertical direction. The heating cooking device further includes a blower fan that is provided on the upper wall of the heating chamber closer to a front of the heating chamber than the center of the heating chamber is when seen from above and is disposed at a position on one of a right side and a left side with respect to the camera as seen from above, and that blows air toward the camera from the one of the right side and the left side.

Since the heater is disposed in accordance with the above configuration, the camera can be disposed on the small upper part of the heating chamber, and air can be strongly blown to the camera by the blower fan.

There may be provided a support frame that has, on a plane perpendicular to the right and left directions, an inlet port to take in air blown from the blower fan, and the camera may be attached to the support frame with the imaging surface of the camera exposed in the inside of the support frame.

This configuration makes it possible to more efficiently blow air to the camera disposed in the small space on the upper part of the heating chamber.

The blower fan may have an exhaust port to blow air, on a plane perpendicular to the right-left direction.

This configuration makes it possible to strongly blow air to the camera disposed in the small space on the upper part of the heating chamber while preventing or reducing pressure loss.

The inlet port of the support frame and the exhaust port of the blower fan may be disposed to face each other in the right-left direction.

This configuration makes it possible to more strongly blow air to the camera disposed in the small space on the upper part of the heating chamber while preventing or reducing pressure loss.

The blower fan may have a fan whose rotation axis is in the vertical direction.

With this configuration, the blower fan can be disposed in the small space on the upper part of the heating chamber in a space-saving manner also in the vertical direction.

INDUSTRIAL APPLICABILITY

The present disclosure can be applied to a heating cooking device the inside of whose chamber is imaged by an imaging unit.

REFERENCE MARKS IN THE DRAWINGS

1 heating cooking device
100 chassis
101 front frame
102 front face opening
105 controller
106*a*, 106*b* magnetron (heater)
107*a*, 107*b* waveguide (heater)
108*a*, 108*b* radiation opening (heater)
109*a*, 109*b* stirrer
110 heating chamber
111*a* upper wall
111*b* left-side wall
111*c* right-side wall
111*d* back wall
111*e* bottom wall
112 wall surface opening
113 wall surface depression
114 depression bottom opening
120 door
121 handle
122 glass window
130 operation unit
131 operation switch
132 display
140 top panel
141 top panel opening
150 imaging unit
151 support frame
151*a* upper wall
151*b* front-side wall
151*c* rear-side wall
151*d* left-side wall
151*e* inlet port
152 imaging opening
153 camera substrate
154 camera
155 shutter
156 drive motor (motor)
160 air blower (blower fan)
161 fan case
162 fan
163 exhaust port
171 upper illuminator (illuminator)
172 left illuminator (illuminator)
200 first air path (air path)
201 second air path

The invention claimed is:

1. A heating cooking device comprising:

a heating chamber having a front face opening, a rear side wall, an upper wall, a right side wall, a left side wall and a bottom, wherein the upper wall and the bottom are parallel to a first plane defined by a first direction that is a left-to-right direction and a second direction that is a front-to-rear direction, and the right side wall and the left side wall are parallel to a second plane defined by the second direction and a third direction that is a vertical direction;

a heater that is provided on the upper wall of the heating chamber to heat an object to be heated stored in the heating chamber, at least part of the heater being disposed at a center of the heating chamber seen from above along the third direction;

a camera that is provided on the upper wall of the heating chamber and is disposed closer to a front of the heating chamber than the center of the heating chamber is when seen from above, wherein the camera has an imaging direction inclined toward the rear side wall of the heating chamber with respect to the third direction;

a blower fan that is provided on the upper wall of the heating chamber, closer to the front of the heating chamber than the center of the heating chamber is when seen from above; and a support frame that is attached to the upper wall, wherein:

at least a part of the blower fan is disposed adjacent to the camera at a position on one of a right side or a left side along the first direction with respect to the camera as seen from above, and blows air toward the camera from the position on the one of the right side and the left side, the support frame includes an upper wall which has a lower face facing the heating chamber and an upper face opposite to the lower face, wherein the camera is attached to the upper face, and the upper face has an imaging opening through which the camera captures an image, and the support frame further includes a side wall protruding from the lower face of the upper wall of the support frame toward the upper wall of the heating chamber and an inlet port to take in the air blown from the blower fan, and the camera is attached to the support frame such that an imaging surface of the camera is exposed inside the support frame and within confines of the side wall.

2. The heating cooking device according to claim 1, wherein the blower fan has, on the second plane, an exhaust port to blow air and the exhaust port faces the inlet port of the support frame.

3. The heating cooking device according to claim 1, wherein the blower fan has, on the second plane, an exhaust port to blow air.

4. The heating cooking device according to claim 3, wherein the inlet port of the support frame and the exhaust port of the blower fan are disposed to face each other in the first direction.

5. The heating cooking device according to claim 1, wherein the blower fan has a fan having a rotation axis in the third direction.

6. The heating cooking device according to claim 2, wherein the blower fan has a fan having a rotation axis in the third direction.

7. The heating cooking device according to claim 3, wherein the blower fan has a fan having a rotation axis in the third direction.

8. The heating cooking device according to claim 4, wherein the blower fan has a fan having a rotation axis in the third direction.

9. The heating cooking device according to claim 1, further comprising a chassis in which the heating chamber is disposed, wherein the camera and the blower fan are disposed in a space between the heating chamber and the chassis.

10. The heating cooking device according to claim 1, wherein the upper wall of the support frame inclines with respect to the upper wall of the heating chamber.

11. The heating cooking device according to claim 1, wherein the upper wall of the heating chamber includes an opening that discharges the air taken in through the inlet port toward inside the heating chamber.

12. The heating cooking device according to claim 11, wherein the air taken in through the inlet port flows along the imaging surface of the camera toward inside the heating chamber.

13. The heating cooking device according to claim 1, wherein a shutter is provided inside the support frame.

* * * * *